US007480956B2

(12) United States Patent
Policicchio et al.

(10) Patent No.: US 7,480,956 B2
(45) Date of Patent: Jan. 27, 2009

(54) CLEANING PADS

(75) Inventors: Nicola John Policicchio, Mason, OH (US); Mary Vjayarani Barnabas, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 911 days.

(21) Appl. No.: 10/866,350

(22) Filed: Jun. 11, 2004

(65) Prior Publication Data

US 2005/0022843 A1 Feb. 3, 2005

Related U.S. Application Data

(60) Provisional application No. 60/477,669, filed on Jun. 11, 2003.

(51) Int. Cl.
*A47L 13/20* (2006.01)

(52) U.S. Cl. ..... 15/228; 15/231; 401/138; 134/6

(58) Field of Classification Search ..... 15/228, 15/231, 229.1, 209.1, 115, 114, 104.93; 428/97, 428/99; 401/138
See application file for complete search history.

(56) References Cited

U.S. PATENT DOCUMENTS 7,163,349 B2 * 1/2007 Policicchio et al. ..... 401/137
2002/0065012 A1 * 5/2002 Takabayashi et al. ..... 442/381
2002/0175092 A1 11/2002 Menif et al.
2003/0049407 A1 * 3/2003 Kacher et al. ..... 428/100
2003/0126709 A1 * 7/2003 Policicchio et al. ..... 15/228
2003/0126710 A1 * 7/2003 Policicchio et al. ..... 15/228
2005/0022843 A1 * 2/2005 Policicchio et al. ..... 134/6

FOREIGN PATENT DOCUMENTS

DE 101 28 858 A 8/2002
WO WO 00/53411 A 9/2000

* cited by examiner

*Primary Examiner*—Lee D Wilson
(74) *Attorney, Agent, or Firm*—Thibault Fayette; Larry L. Huston

(57) ABSTRACT

Cleaning pads for cleaning a hard surface with a cleaning implement are provided. A cleaning pad can have distinct high friction region(s) and low friction(s). A cleaning pad can also have distinct hydrophilic region(s) and hydrophobic region(s).

A method of cleaning a floor surface with a cleaning implement and a cleaning pad by applying a cleaning solution on the floor surface while the implement and the pad are not in contact with the floor surface and then wipe the floor surface with the pad, is also provided.

11 Claims, 10 Drawing Sheets

CLEANING PADS

CROSS REFERENCE TO RELATED APPLICATION

This application claims benefit of U.S. Provisional patent application 60/477,669, filed Jun. 11, 2003.

TECHNICAL FIELD

The present invention relates to cleaning pads useful for removing soils/dirt from hard surfaces and which can be used with a variety of cleaning implements. The cleaning pads comprise a bottom layer with a "functional" surface having high friction region(s) and low friction region(s). The present invention further relates to methods of using the cleaning pads with a cleaning implement to clean hard surfaces.

BACKGROUND OF THE INVENTION

The literature is replete with products capable of cleaning hard surfaces such as ceramic tile floors, hardwood floors, counter tops and the like. In the context of cleaning floors, and in particular in the context of cleaning floors with a cleaning solution, numerous devices are described comprising a handle rotatably connected to a mop head having retaining means for maintaining an absorbent cleaning pad attached during the cleaning operation and a liquid delivery mechanism connected to the handle for dispensing a cleaning solution on the floor surface.

Typical disposable cleaning pads used with these devices include a bottom layer (also called floor sheet or scrubbing layer) and an absorbent core. The bottom layer includes a "functional" surface which is the surface (generally the lower surface) in contact with the hard surface during the cleaning operation.

One example of a "wet" cleaning device is the SWIFFER WETJET® cleaning implement, sold by The Procter & Gamble Company, which produces a spray of fine droplets of liquid delivered onto an area of about 0.3 $m^2$. The SWIFFER WETJET® implement is preferably used with disposable absorbent cleaning pads, such as the SWIFFER WETJET® cleaning pads, which has an absorbent core comprising a water insoluble, water-swellable superabsorbent gelling polymers having a high absorbent capacity for absorbing and locking the soiled solution removed from the hard surface. The combination of this type of pad with the previously described implement is optimized in the sense that the cleaning solution is spread over a large area and the pad is designed to assure that only a minimum amount of dirty solution is squeezed out of the pad and released back onto the hard surface.

Another example of such a cleaning device is the CLOROX® READY-MOP® cleaning implement, sold by The Clorox Company, which includes a liquid delivery mechanism removably attachable to a reservoir. This liquid delivery mechanism only uses the potential energy of the column of liquid in the reservoir to dispense a puddle of solution onto the hard surface in front of the implement. This implement can be used with a disposable cleaning pad, such as the READY-MOP® cleaning pad which has an absorbent core predominantly made of a cellulosic material. This pad has a relatively low absorbent capacity and tend to release much more of the dirty solution onto the hard surface in comparison to the WETJET® cleaning pad.

One would assume that a SWIFFER WETJET® type cleaning pad, when used with an implement which delivers the cleaning solution over a small area such as CLOROX® READY-MOP® implement, would provide the same benefits as when this pad is used with a WETJET® implement. It is found however, that because the implement dispenses the cleaning solution over a relatively small area, the cleaning efficacy of this pad is not fully optimized.

It is therefore one object of this invention to provide an optimized cleaning pad which can be used with a cleaning implement that delivers the solution within a relatively small area.

It is also another object of this invention to provide a method of cleaning a hard surface with a cleaning implement conceived to deliver a cleaning solution within a relatively small area of the surface to be cleaned with a cleaning pad offering the same benefits as the superabsorbent type cleaning pads discussed hereinbefore without any of the negatives (such as for example, low absorbent capacity and liquid release) previously discussed.

SUMMARY OF THE INVENTION

The present invention relates to disposable cleaning pads which are usable with a variety of cleaning implements.

In one embodiment, a disposable cleaning pad has a bottom layer and an absorbent layer located on top of the bottom layer. The lower surface of the bottom layer comprises a functional surface having a high friction region and a low friction region.

In another embodiment, the bottom layer of a disposable cleaning pad comprises a first layer made of a hydrophilic material and a second layer made of a hydrophobic material and located on top of the first layer.

In another embodiment, the lower surface of the bottom layer comprises a functional surface having a high friction region and a low friction region such that the high friction region has a "low dose Kinetic Coefficient of Friction" of at least about 0.35.

DETAILED DESCRIPTION OF THE INVENTION

Figure 1:
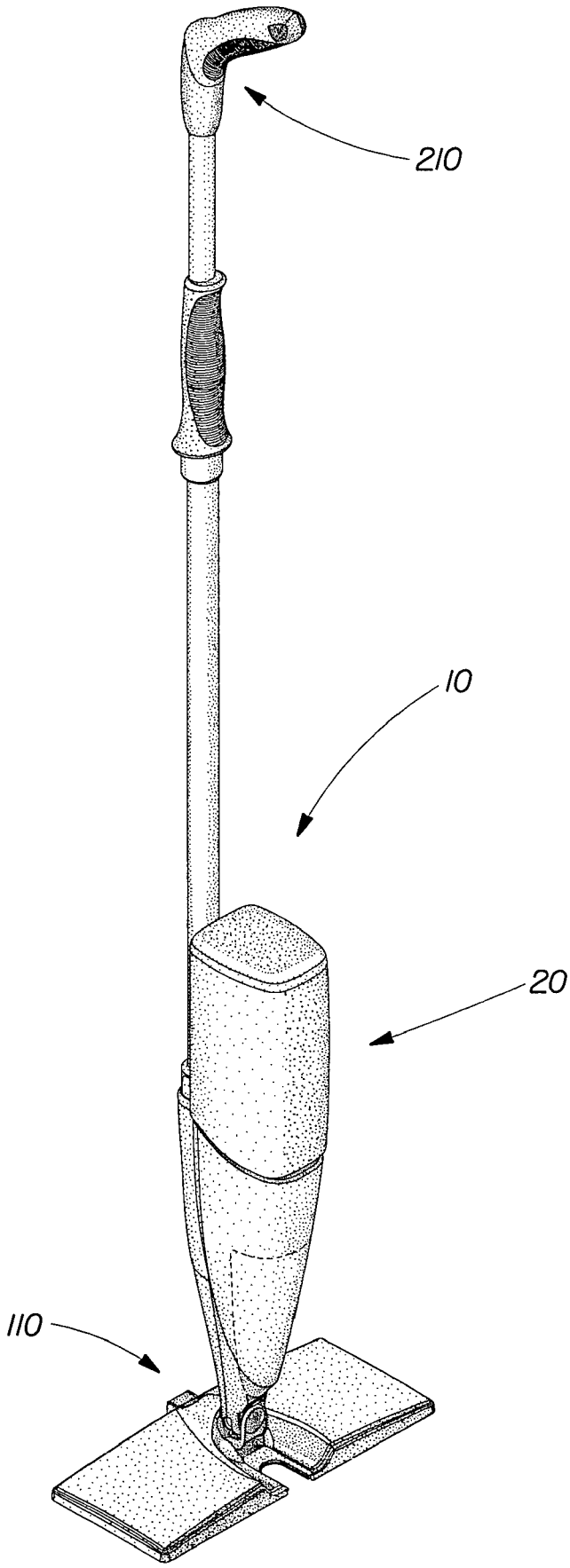
FIG. 1 is an isometric view of one example of a "wet" cleaning implement.

All documents cited herein are, in relevant part, incorporated herein by reference; the citation of any document is not to be construed as an admission that it is prior art with respect to the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All parts, ratios, and percentages herein, in the Specification, Examples, and claims, are by weight and all numerical limits are used with the normal degree of accuracy afforded by the art, unless otherwise specified.

Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements.

I. Definitions

As used herein, the term "direct fluid communication" means that fluid can transfer readily between two cleaning pad components or layers (e.g., the floor sheet and the absorbent layer) without substantial accumulation, transport, or restriction by an interposed layer. For example, tissues, nonwoven webs, construction adhesives, and the like can be present between the two distinct components while maintaining "direct fluid communication", as long as they do not substantially impede or restrict fluid as it passes from one component or layer to another.

As used herein, the term "x-y dimension" refers to the plane orthogonal to the thickness of the cleaning pad (generally in the z dimension), or a component thereof. The x and y dimensions correspond to the length and width, respectively, of the cleaning pad or a pad component. In general, when the cleaning pad is used in conjunction with a handle, the implement will be moved in a direction parallel to the y-dimension (or width) of the pad.

Of course, the present invention is not limited to cleaning pads having four sides. Other shapes, such as circular, elliptical, and the like, can also be used. When determining the width of the pad at any point in the z-dimension, it is understood that the pad is assessed according to its intended use.

As used herein, the term "layer" refers to a member or component of a cleaning pad whose primary dimension is x-y, i.e., along its length and width. It should be understood that the term layer is not necessarily limited to single layers or sheets of material. Thus a layer can comprise laminates or combinations of several sheets or webs of the requisite type of materials. Accordingly, the term "layer" includes the terms "layers" and "layered."

As used herein, the term "hydrophilic" is used to refer to surfaces that are wettable by aqueous fluids deposited thereon. Hydrophilicity and wettability are typically defined in terms of contact angle and the surface tension of the fluids and solid surfaces involved. This is discussed in detail in the American Chemical Society publication entitled Contact Angle. Wettability and Adhesion, edited by Robert F. Gould (Copyright 1964), which is hereby incorporated herein by reference. A surface is said to be wetted (i.e., hydrophilic) by deionized water when either the contact angle between the water and the surface is less than 90°, or when the fluid tends to spread spontaneously across the surface, both conditions normally co-existing. Conversely, a surface is considered to be "hydrophobic" if the contact angle is greater than 90° and the water does not spread spontaneously across the surface. The term "naturally hydrophilic" refers to compositions based on naturally occurring polymers such as cellulose pulp, cotton, hemp, jute as well as composition based on naturally occurring polymers such as rayon, acetate, triacetate and the like. Additionally the term, "naturally hydrophobic" refers to compositions that are typically based on synthetic polymers such as polyethelene, polypropylene, polyester and mixtures thereof.

As used herein, the term "transient" when referring to a characteristic of a material the ability of a material to readily allow soil and liquid to pass through the material without being substantially absorbed or "hung-up" on or within the material. Typically, materials that have high transient characteristics are composed of high levels of synthetic polymers (greater than about 60%), and have typically a low basis weight (less than about 40 g/m2) and a low density (less than about 0.09 g/cm$^3$). Higher basis weight and/or materials with high synthetic content (greater than about 90%) can be made more transient by creating apertures in the material such as an apertured polyethylene film.

As used herein, the term "upper surface" when referring to a layer of a cleaning pad or when referring to a mop head, means the surface which is the furthest away from the floor surface during normal cleaning conditions. Conversely, the term "lower surface" means the surface which is the closest from the floor surface during normal cleaning conditions.

For purposes of the present invention, a "top" layer of a cleaning pad is a layer that is relatively further away from the surface to be cleaned (i.e., in the implement context, relatively closer to the implement handle during use). The term "bottom" layer conversely means a layer of a cleaning pad that is relatively closer to the surface that is to be cleaned (i.e., in the implement context, relatively further away from the implement handle during use). The terms "top" and "bottom" are similarly used when referring to layers that are multi-ply (e.g., when the bottom layer is a two-ply material). In terms of sequential ordering of layers (e.g., first layer, second layer, and third layer), a first layer is a "lower" layer relative to a second layer. Conversely, a third layer is a layer positioned on top of a second layer. The terms "above" and "below" are used to describe relative locations of two or more materials in a cleaning pad's thickness. By way of illustration, a material A is "above" material B if material B is positioned closer to the floor surface than material A during normal cleaning conditions. Similarly, material B is "below" material A in this illustration.

II. Cleaning Implements and Cleaning Pads

While not intending to limit the utility of the cleaning herein, it is believed that a brief description of its use in association with a modern mopping implement will help elucidate the invention.

In heretofore conventional wet-mopping operations, the mop user requires a source of detersive liquid for application to the surface being cleaned by means of the mop head. Earlier practice was to dip the mop head into an external source of liquid, such as a bucket, optionally wring-out the excess of liquid, and then apply the mop head to the surface with sufficient force to dislodge soil therefrom. Unfortunately, after repeated usage, the mop heads themselves, become dirty, unsanitary, unsightly and have to be removed and laundered.

modern cleaning implements employ disposable sheets or absorbent pads, which are releasably affixed to the head of the mopping implement, and which can conveniently be discarded and replaced after soiling. Even more modern implements (hereinafter referred to as "wet cleaning implement") carry their own reservoir of detersive liquid, thereby greatly enhancing their usefulness and convenience. In use, the liquid is dispensed onto the surface being cleaned via a liquid delivery mechanism. These wet cleaning implements have a handle which is rotatably connected to a mop head. The mop head of these implements can have retaining means located on the top or the bottom surface of the mop head for mechanically engaging and retaining an absorbent cleaning pad. The cleaning solution is typically stored in a reservoir which is removably attachable to the fluid delivery mechanism. Non-limiting examples of "modern" cleaning implements include the SWIFFER WETJET® and the SWIFFER SPRAY&CLEAN™ cleaning implements both sold by The Procter & Gamble Company, the CLOROX READY-MOP® sold by The Clorox Company and the GRAB-IT GO-MOP™ sold by The S. C. Johnson Company.

FIG. 1 shows one example of such a "modern" wet cleaning implement 10 which includes an electrically powered liquid delivery mechanism (not show). In one embodiment, the electrically powered delivery mechanism comprises a gear pump in fluid communication with the reservoir 20. The gear pump is connected to an electrical motor which is powered by at least one battery. The gear pump is in fluid communication with a nozzle 110 connected to the mop head. A user can actuate this electrically powered delivery mechanism via a trigger mechanism (not shown) located on the handle 210. When it is actuated by a user, this implement generates a spray of fine droplets of liquid at a flow rate of between about 1 mls/sec and between about 10 mls/sec which is delivered onto an area of between about 0.1 $m^2$ and about 1 $m^2$ in front of the mop head. The total weight of the implement during use and, as a result, the pressure exerted on the pad, depends on the weight of each individual elements forming the implement as well as the reservoir capacity and the amount of cleaning solution remaining in the reservoir. As a result, the total weight of the implement in this example varies between about 950 grams and about 2000 grams. This cleaning implement also comprises hook fasteners (not shown) attached to the bottom surface of the mop head and which are suitable for mechanically engaging and retaining loop fasteners located on the top surface of a cleaning pad. One example of such an electrically powered cleaning implement is the SWIFFER WETJET® implement sold by The Procter & Gamble Company and described in PCT publication WO 01/22861 to Kunkler et al. published Apr. 5, 2001, PCT publication WO 00/27271 to Policicchio et al., published May 18, 2000 all assigned to The Procter & Gamble Company.

Figure 2:
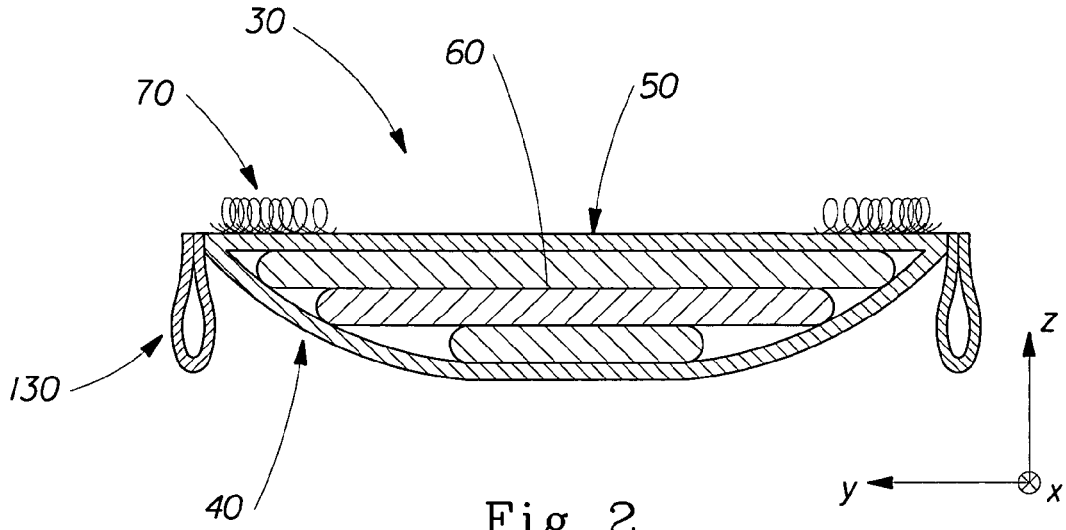
FIG. 2 is a cross-sectional view of a cleaning pad which can be used with the implement of FIG. 1.
Figure 3:
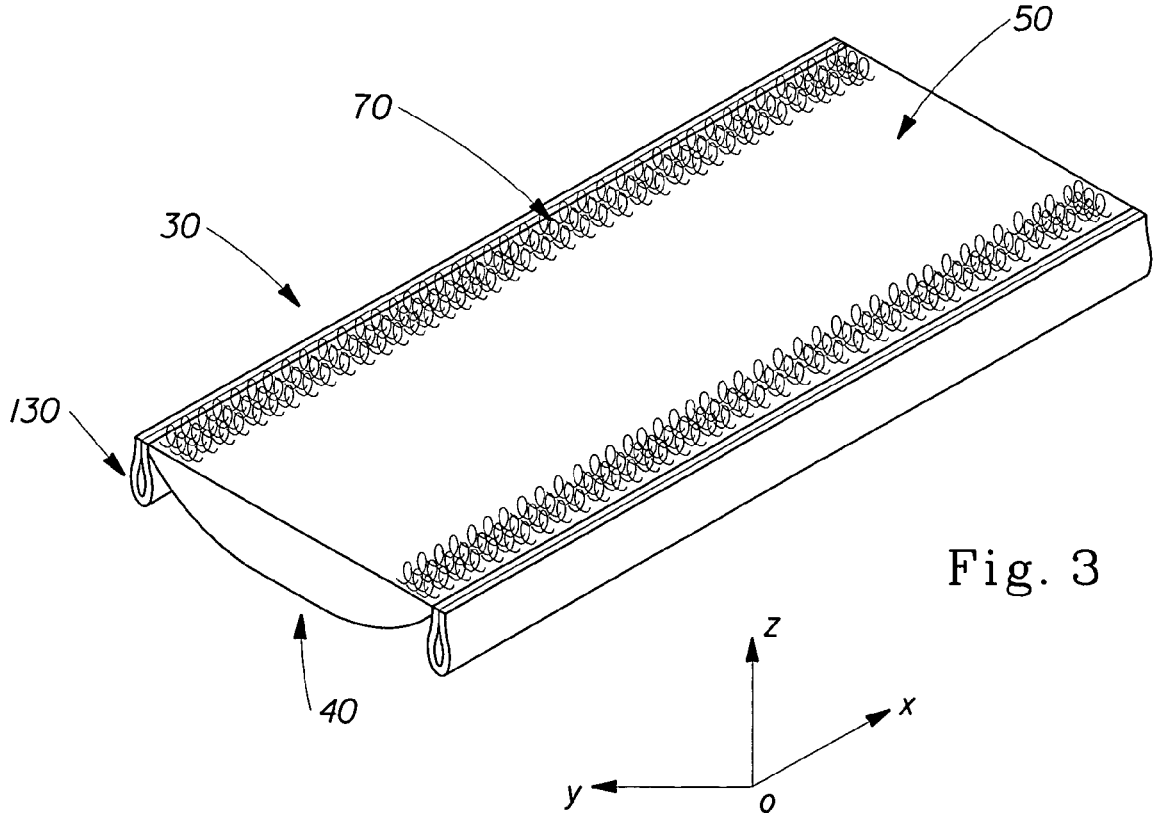
FIG. 3 is an isometric view of the cleaning pad of FIG. 2.

The cleaning implement shown in FIG. 1 is typically used with disposable absorbent cleaning pad, shown in FIGS. 2 and 3, which can be releasably connected to the bottom surface of the mop head of the implement. This pad 30 comprises a bottom layer 40, a top layer 50 and an absorbent core 60 in between the bottom and top layers. This pad includes loop fasteners 70 for attaching the pad to corresponding hook fasteners (not shown) located on the bottom surface of the mop head. The bottom layer 40 of this pad is made of an apertured formed film, made of polyethylene, with a plurality of "funnel" shape openings extending towards the absorbent core. Since the smaller diameter of the funnels is close to the core and the larger diameter of the funnels is close to the hard surface, each of these "funnel" shape openings act as "miniature" one-way valves facilitating the flow of liquid towards the absorbent core but limiting the release of the liquid back onto the hard surface. The formed film used for the bottom layer of this pad is described in greater detail in U.S. Pat. No. 4,463,045, U.S. Pat. No. 4,342,314 and U.S. Pat. No. 4,041,951, all assigned to The Procter & Gamble Company. Since this bottom layer is composed of a synthetic polymer, it is "naturally hydrophobic" in characteristic and consequently it has low affinity for retaining dirt and water on its surface. However, because the material is composed of an essentially smooth synthetic polymer, it results in the pad having a relatively low friction when the pad is wiped against a wet surface. In addition, the absorbent core of these pads includes a water insoluble, water-swellable superabsorbent gelling polymers which are well known in the literature and are described in greater detail in PCT publication WO 00/27271 to Policicchio et al. These superabsorbent gelling polymers have a high absorbent capacity for absorbing and locking the soiled solution removed from the hard surface. In addition, this cleaning pad comprises functional "cuffs" 130 which can flip back and forth during the moping operation. These functional cuffs are beneficial to trap hair and/or large particulates which are not easily carried by the cleaning solution and cannot flow through the funnel shape openings. These functional cuffs are described in greater detail in PCT publication WO 00/27271 to Policicchio et al., and PCT publication WO 02/41743 to Policicchio, published May 30, 2002, assigned to The Procter & Gamble Company. The combination of this type of pad with the previously described implement is optimized in the sense that the cleaning solution is dispensed by the electrically powered liquid delivery mechanism over a relatively large area and the pad is designed to ensure that the dirt is locked within the absorbent core and only a minimum amount of solution is released back onto the hard surface. In addition, the relatively heavy weight of the implement compensates for the low friction between the pad and the wet surface. One example of a suitable cleaning pad for use with the electrically powered cleaning implement is the SWIFFER WETJET® cleaning pad and is described in greater detail in PCT publication WO 98/11812 to Holt et al., published Mar. 26, 1998 and assigned to The Procter & Gamble Company. One skilled in the art will understand that other liquid delivery mechanisms are capable of applying a similar spray of fine droplets onto a relatively large area. Non-limiting examples of suitable liquid delivery mechanisms include mechanisms capable of pressurizing the liquid stored in the container via a manually operated pump or pre-pressurized containers such as aerosol containers or deformable elastic containers capable of exercising a pressure on a liquid stored therein.

Figure 4:
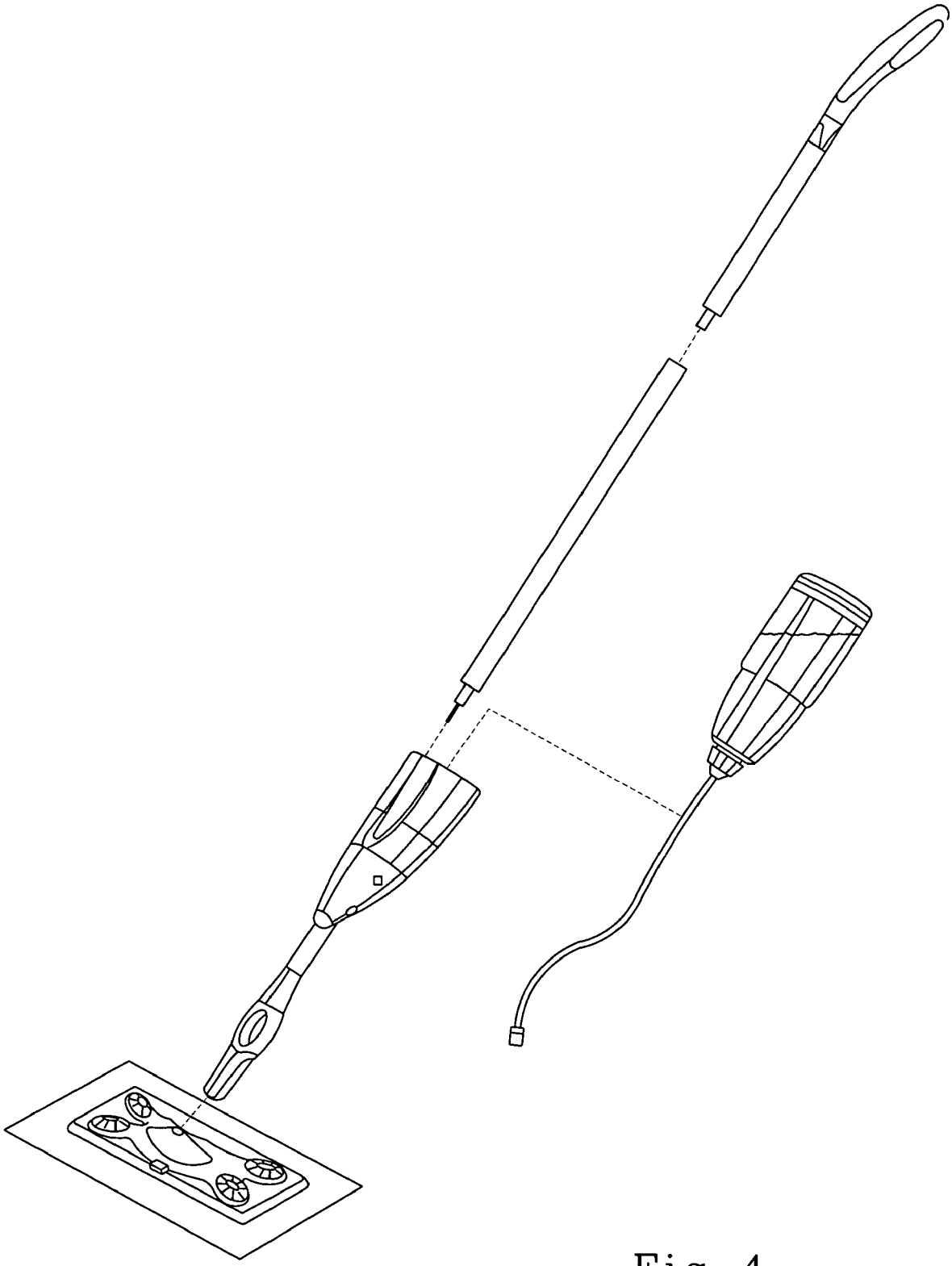
FIG. 4 an isometric view of another example of a "wet" cleaning implement.

FIG. 4 shows another example of a modern wet cleaning implement such as the CLOROX® READY-MOP® cleaning implement sold by The Clorox Company and described in PCT publication WO 01/72185 to Hall et al., published Oct. 4, 2001 and assigned to The Clorox Company. This cleaning implement has a handle connected to a mop head, a liquid delivery mechanism removably attachable to a reservoir. The liquid delivery mechanism used with this implement is a gravity-fed mechanism and only uses the potential energy of the column of liquid in the reservoir to deliver the solution onto the hard surface. This gravity-fed delivery mechanism is in fluid communication with a nozzle connected to the mop head and produces a flow rate of between about 1 mils/sec and about 3 mils/sec and delivers the cleaning solution within an area of between about 0.01 $m^2$ and about 0.05 $m^2$ when the delivery mechanism is actuated for a few seconds. The total weight of the implement during use also depends on the amount of solution remaining in the reservoir varies between 700 grams and 1450 grams.

The manufacturer's instructions recommend to use this cleaning implement with the READY-MOP® cleaning pads, which can be removably connected to grippers located on the mop head of the implement. This cleaning pad includes a bottom layer, a top layer and an absorbent core in between the bottom and top layers. The width of the bottom layer of this pad is greater than the width of the mop head such that the bottom layer can be inserted into and retained by "pinchers" or "grippers" located on the top surface of the mop head of this implement. The bottom layer of this pad is made of a homogeneous blend of naturally hydrophilic rayon and naturally hydrophobic fibers (polyester or polypropylene) at an estimated level of between about 60-70% naturally hydrophilic and between about 3040% naturally hydrophobic synthetic fibers. The fibers forming the bottom layer are meshed to create relatively large apertures allowing particulates to reach the absorbent core. The apertures are spaced about 3 mm apart, they cover a surface in the X-Y dimension of between about 2 and 3 $mm^2$ and have a depth of about 0.75 mm. The bottom layer of this pad is overall "naturally hydrophilic" resulting in a greater affinity for dirt and water and relatively high friction when the pad is wiped against a wet surface. During normal cleaning operation, the dirt tends to accumulate at the lower surface of this bottom layer. The absorbent core of this pad is predominantly made of a cellulosic material which has a relatively low absorbent capacity in comparison to the SWIFFER WETJET® pads which combine a cellulosic material and superabsorbent gelling polymers. When pressure is applied onto a CLOROX® type pad, such as during a typical cleaning operation, the pad tends to release back some of the dirty solution onto the hard surface. When a user actuates the liquid delivery mechanism of this implement, a puddle of cleaning solution is formed in front of the mop head. As the user cleans the hard surface, this pad becomes saturated with liquid and, as a result, it spreads the excess solution over a larger area while the user is wiping the hard surface. The saturation of the pad can be beneficial in the sense that it compensates for the relatively small coverage area generated by the gravity-fed mechanism. In addition, the hydrophilicity of the bottom layer provides higher friction when the pad is wiped against a wet surface due to the strong hydrogen bonds present on the lower surface (i.e. interface). This higher friction compensates for the relative lightweight of the implement. While the openings provided by the mesh design of the bottom layer provides channels for some dirt to enter into the absorbent core, these "large deep openings" create gross texturing which can "paint" lines when the pad is wiped over the cleaning solution applied on the hard surface. These lines can make the solution dry unevenly and thus lead to undesirable streaking on the hard surface. Additionally since bottom layer is hydrophilic and the absorbent core has low absorbent capacity, an excess of dirty solution will be squeezed out of the pad as it gets quickly saturated which can subsequently lead to a surface with an undesirable hazy appearance after the solution dries. This hazy appearance results from non-volatile actives from the solution in combination with insoluble and soluble soil particulates which are concentrated in the pad and re-deposited back onto floor. The combination of this pad and this implement essentially creates a wet pad, functionally similar to pre-moistened cleaning pads such as the SWIFFER WETS cleaning pad (sold by The Procter & Gamble Company) or PLEDGE GRAB-IT® cleaning pad (sold by the S. C. Johnson Company). However, unlike wet wipes, which are changed after they no longer wet the floor, these types of pads are used much longer and can lead to poor end result cleaning performance in the event they are not replaced regularly.

When a cleaning pad with an absorbent core comprising a superabsorbent material and a apertured formed film bottom layer as previously described, is used with a cleaning implement which dispenses the cleaning solution in a concentrated small area, the following is observed. This a pad absorbs the puddle of cleaning solution in front of the mop head quickly, and consequently requires the user to apply a greater amount of cleaning solution. A user intuitively associates an increase in friction and the visual wetting of the surface during the wiping operation with the need to apply more cleaning solution. As the pad quickly absorbs the solution with minimum release of this solution back on the hard surface, an essentially dry pad is wiped against a dry soiled surface leading to uneven cleaning until more solution is applied. In addition, when a user is required to apply solution too frequently, the user may perceive that more solution than is necessary is being applied on the hard surface.

The relative lightweight of implements, such as the CLOROX READYMOP® in comparison to electrically powered implements, such as the SWIFFER WETJET® implement, does not compensate for the low friction of the formed film layer when the pad is wiped against the wet surface. This low friction gives the user the sensation that the pad is "gliding" excessively against the hard surface. This sensation hinders the user's intuition that friction or glide resistance is necessary for efficient cleaning. In order to obtain higher friction, a user has to apply a greater amount of force on the handle of the implement leading to unnecessary mechanical constraints being applied to various parts of the implement (for example the universal joint) as well as the pad. As a result, the user can perceive the cleaning system as being inconvenient.

When a superabsorbent material is included in the absorbent core of a cleaning pad having a bottom layer made of an homogeneous blend of hydrophilic and hydrophobic fibers and having large apertures as previously described, and this pad is used with a cleaning implement which dispenses the cleaning solution in a concentrated area, the following observations have been made. Since the bottom layer does not effectively limit the flow of solution out of the absorbent core towards the hard surface, some of the dirty solution is released back onto the hard surface when pressure is applied on the pad. In addition, the bottom layer of the CLOROX® READY-MOP® pad creates lines on the surface being cleaned which result in unwanted filming and streaking.

The foregoing considerations are addressed by the present invention, as will be clear from the detailed disclosures which follow.

For the sake of clarity, only the bottom layer and the absorbent core of the following embodiments of a cleaning pad are schematically represented. Nevertheless, one skilled in the art will understand that the following cleaning pads can include additional features such as a top layer (located on top of the absorbent layer), one or more functional cuffs as previously discussed and that the pads can be removably connected to the mop head of a cleaning implement via any mechanism known in the art such as retaining means located on the top or bottom surface of the mop head.

Figure 5:
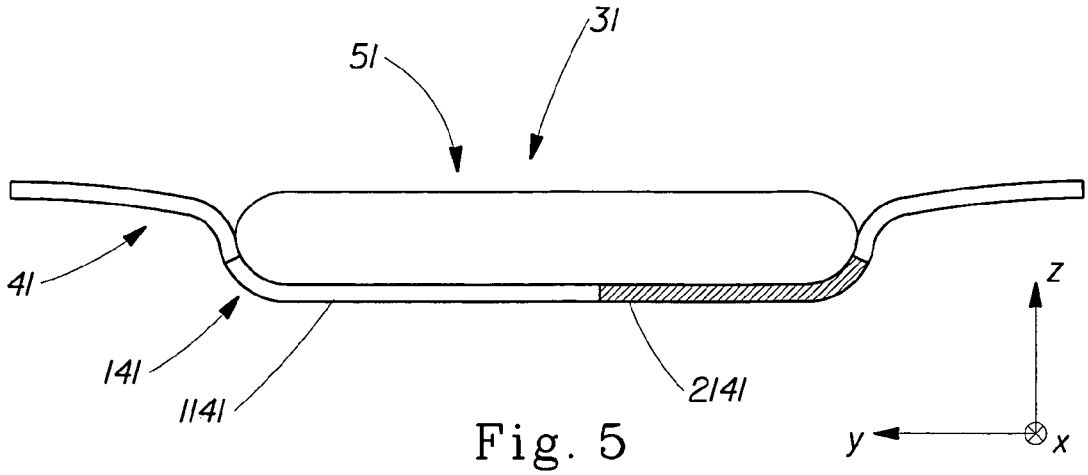
FIG. 5 is a cross-sectional view of one embodiment of a cleaning pad.
Figure 6:
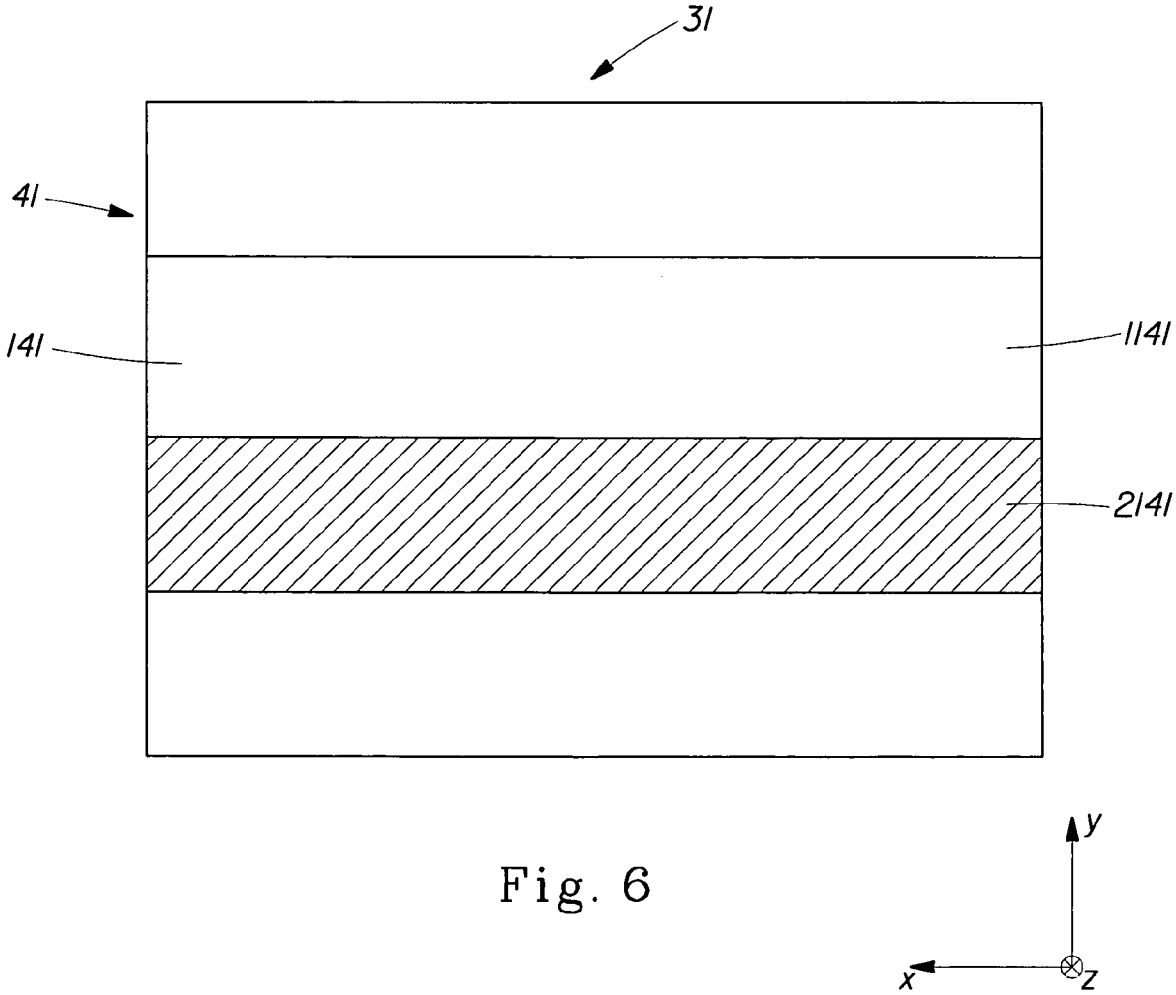
FIG. 6 is a bottom view of the cleaning pad of FIG. 5.

In one embodiment represented in FIGS. 5 and 6, a cleaning pad 31 comprises a bottom layer 41 in direct fluid communication with an absorbent core 51.

Non-limiting examples of suitable materials used for the absorbent core are described in detail in PCT publication WO 00/27271 to Policicchio et al.

The bottom layer has a "functional" surface 141 with at least one low friction region 1141 and at least one high friction region 2141 (for illustration purposes the high friction region(s) is schematically represented with cross-section lines to distinguish from the low friction region(s)).

By "functional surface" it is meant the surface of the bottom layer which is in contact with the hard surface during the cleaning operation with a cleaning implement.

By "high friction region" and "low friction region" it is meant that the high friction region generates a greater amount of friction than the low friction region when they are both wiped against a same hard surface (i.e. one region provides more friction than the other region).

In one embodiment, the total lower surface of the high friction region(s) in the X-Y dimension is between about 5% and about 50%, preferably between about 10% and about 40%, more preferably between about 15% and about 35%, even more preferably between about 20% and about 30% of the "functional" surface of the pad. In such an embodiment, the total area or surface of the lower surface of the low friction region(s) in the X-Y dimension is between about 50% and about 95%, preferably between about 60% and about 90%, more preferably between about 65% and about 85% and even more preferably between about 70% and 80% of the "functional" surface of the pad.

Figure 7:
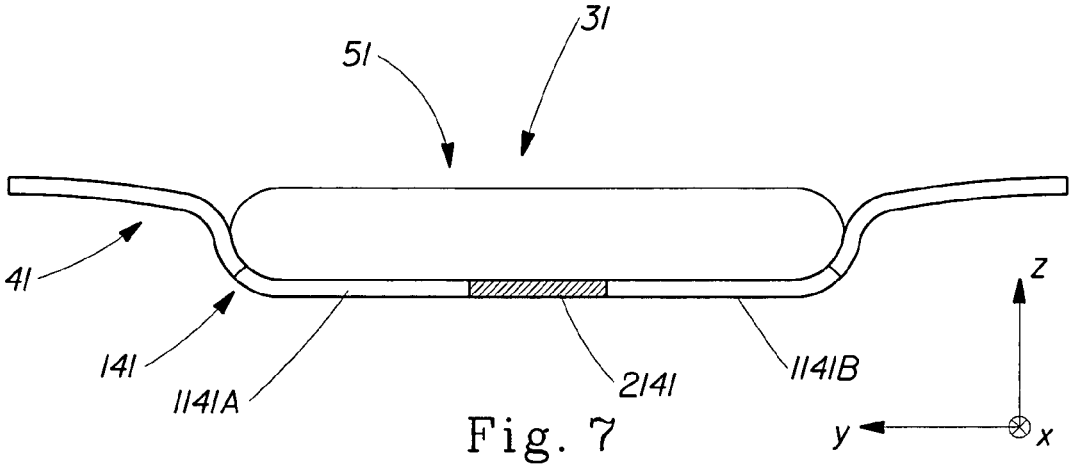
FIG. 7 is a cross-sectional view of another embodiment of a cleaning pad.
Figure 8:
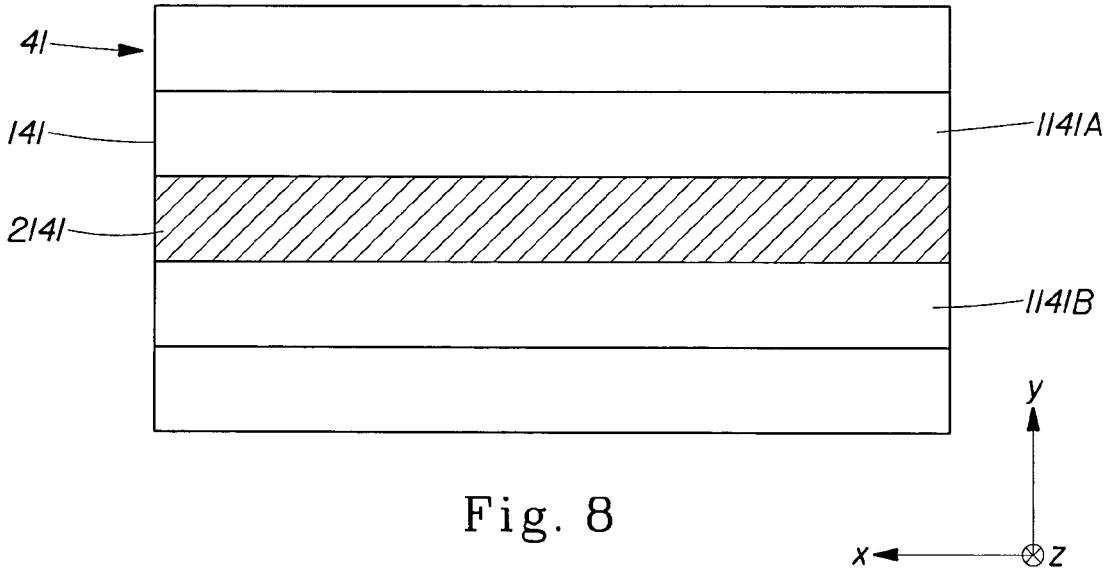
FIG. 8 is a bottom view of the cleaning pad of FIG. 7.

In one embodiment shown in FIGS. 7 and 8, the bottom layer 41 of the pad comprises a longitudinal high friction region 2141 located in the middle portion of the bottom layer 41 and a first and second longitudinal low friction regions 1141A, 1141B which are respectively adjacent to the front and back edges of the bottom layer 41.

Figure 9:
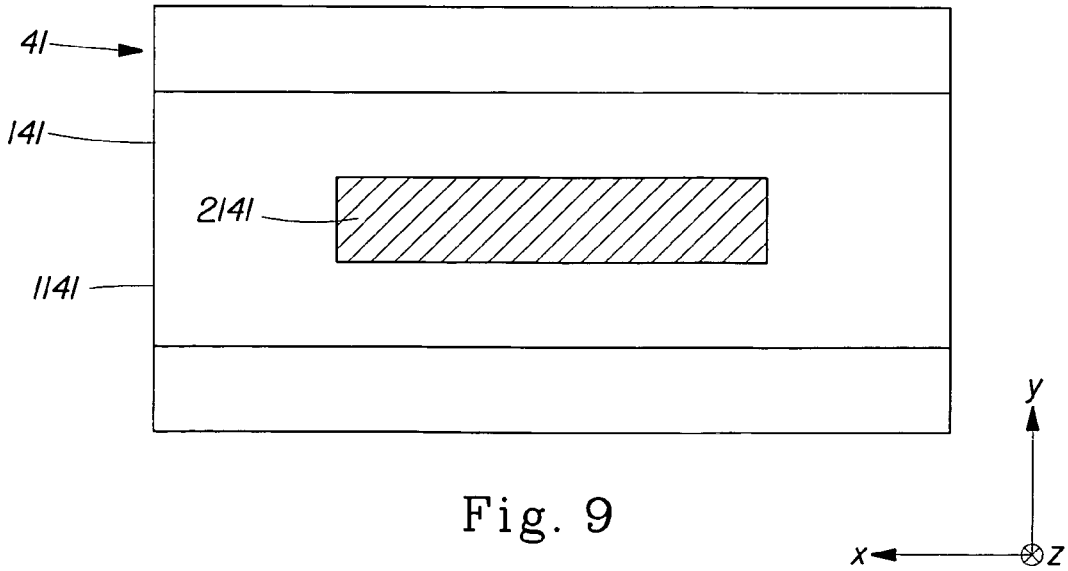
FIG. 9 is a bottom view of another embodiment of a cleaning pad.

In one embodiment shown in FIG. 9, the length of the longitudinal high friction region 2141 is less than the length of the "functional" surface of the pad. In one embodiment, the length (i.e. along the X axis) of the high friction region 2141 is at least about 10%, preferably at least about 20%, more preferably at least about 30% less than the length of the "functional" surface. In one embodiment, the width of the high friction region 2141 (i.e. along the Y axis) is at least about 20%, preferably at least about 40%, more preferably at least about 60% smaller than the width of the "functional" surface 141.

Figure 10:
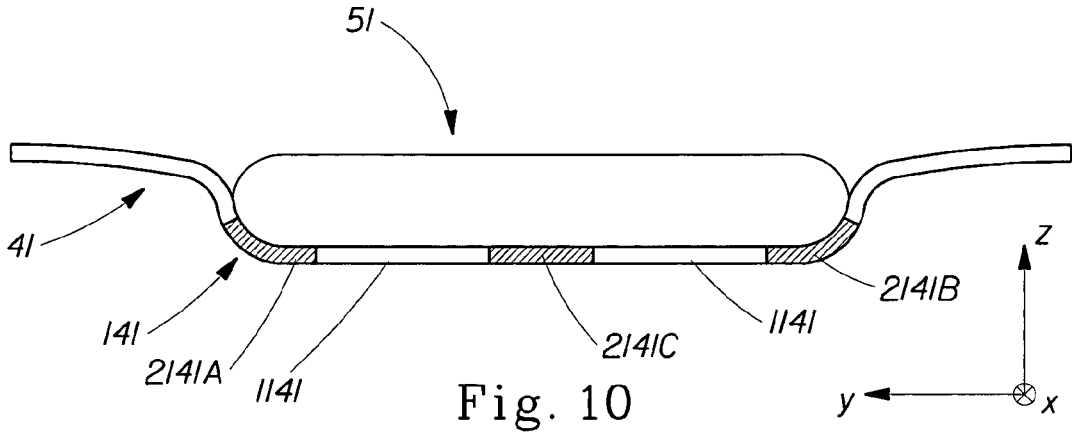
FIG. 10 is a cross-sectional view of another embodiment of a cleaning pad.
Figure 11:
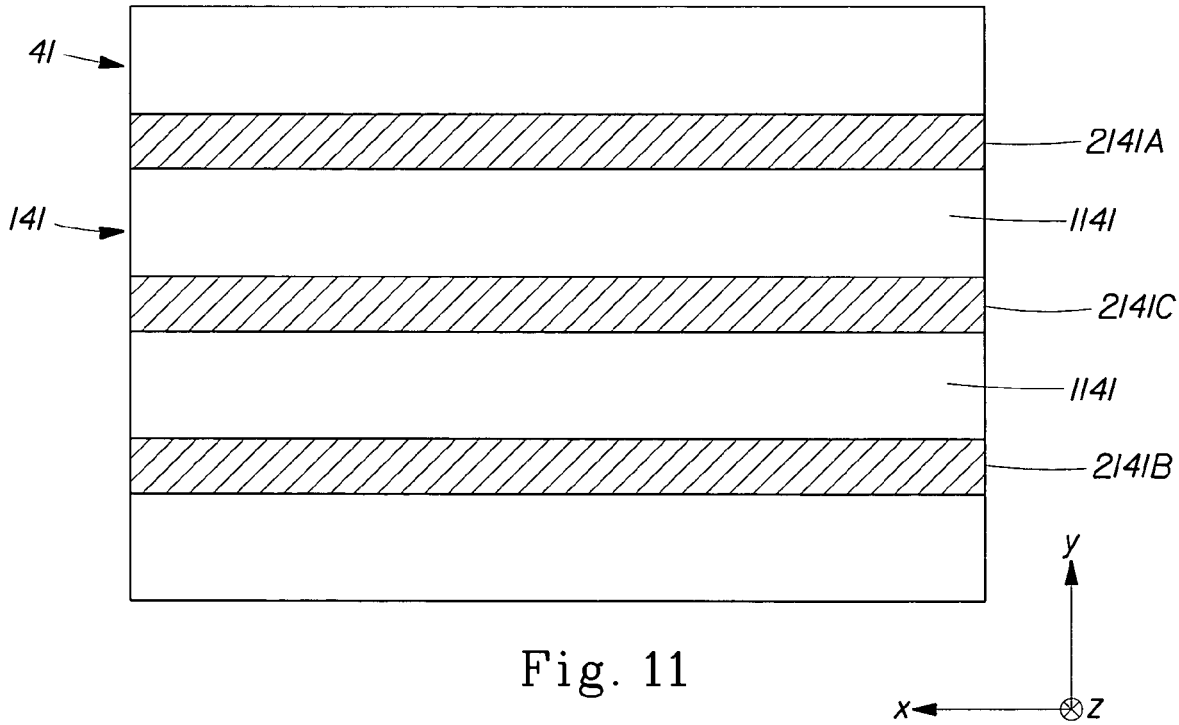
FIG. 11 is a bottom view of the cleaning pad of FIG. 10.

In one embodiment shown in FIGS. 10 and 11, the "functional" surface 141 of the bottom layer 41 comprises a plurality of high friction regions 2141. In one embodiment, the "functional" surface comprises a first high friction region 2141A which is adjacent to the front leading edge 3141 of the "functional" area 141, a second high friction region 2141B which is adjacent to the back edge 4141 of the "functional" area 141 and a third high friction region 2141C which is located in between the first and second high friction region 2141A and 2141B. In one embodiment, the high friction regions 2141A, 2141B and 2141C are all made of the same material and/or have the same physical properties such as hydrophilicity, basis weight, caliper, lengths and/or widths. In another embodiment, the high friction regions can be made of different materials and/or have different physical properties including different levels of friction and/or surface wetting ability.

In one embodiment, the high friction region(s) and low friction region(s) are substantially located on the same plane or level. A high friction region can be connected an/or bonded to a low friction region via any process known in the art. Non-limiting examples of suitable bonding processes include adhesive bonding, thermo-bonding, ultrasonic bonding, needle punching, stitching or sewing, and any combinations thereof.

Figure 12:
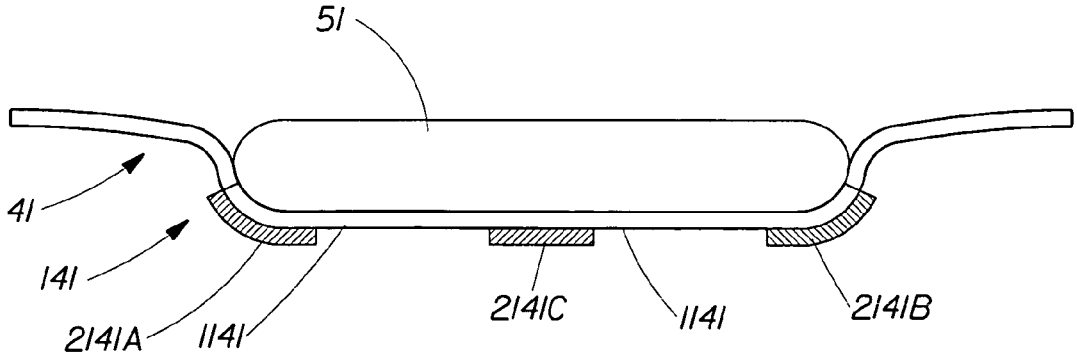
FIG. 12 is a cross-sectional view of another embodiment of a cleaning pad.

In another embodiment shown in FIG. 12, the high friction region(s) and low friction region(s) are located on different planes or levels. For examples, a bottom layer can be made by connecting a hydrophilic layer to the lower surface of a hydrophobic layer such that at least a portion of both the hydrophilic and hydrophobic regions can contact the floor surface.

One skilled in the art will understand that the location of the hydrophilic and hydrophobic regions on the "functional" surface can be inverted and also that the shape of these regions in the X-Y dimension can be any geometric shape known in the art such as polygonal, sinusoidal, arch (such as parabolic or hyperbolic), triangular, V-shape, disk-shape, cross or X-shape, and any combinations thereof.

In one embodiment, the high friction region(s) is made of a substrate material comprising naturally derived hydrophilic fibers. Non-limiting examples of hydrophilic fibers include those which are naturally occurring such as cellulose pulp, cotton, hemp, jute as well as fibers based on natural polymers but are man made such as rayon, acetate, triacetate and the like.

In one embodiment, the low friction region(s) is made of a substrate material comprising hydrophobic fibers. Non-limiting examples of hydrophobic fibers include fibers made of synthetic polymers such as polyethylene, polypropylene, polyester, acrylic and mixtures thereof (such as those formed as bicomponents).

In a preferred embodiment, the low friction region(s) comprises a hydrophobic nonwoven material and the high friction region(s) comprises a hydrophilic nonwoven material.

Without intending to be bound by any theory, it is believed that higher friction is due to the higher affinity for water of the naturally derived hydrophilic fibers because of the presence of hydroxyl groups in those fibers. These hydroxyl groups serve as sorption sites. Additionally, as these sorption sites absorb water, they also provide 'grip' or friction on the surface.

Friction depends partly on the smoothness of the contacting surfaces, a greater force being needed to move two surfaces past one another if they are rough rather than if they are smooth. However, friction decreases with smoothness only to a certain degree; friction actually increases between two extremely smooth surfaces because of increased attractive electrostatic forces between their atoms. Friction does not depend on the amount of surface area in contact between the moving bodies or (within certain limits) on the relative speed of the bodies. It does, however, depend on the magnitude of the forces holding the bodies together. When a body is moving over a horizontal surface, it presses down against the surface with a force equal to its weight, i.e., to the pull of gravity upon it; an increase in the weight of the body causes an increase in the amount of resistance offered to the relative motion of the surfaces in contact.

When a wet hydrophilic, e.g., cellulosic substrate, is pressed against a surface and forced to move, the friction is higher than when it is dry due to extensive hydrogen bonds (between hydroxyl groups of cellulose substrate and water). These hydrogen bonds create a strong electrostatic attraction between two independent polar molecules, i.e., molecules in which the charges are unevenly distributed, usually containing oxygen or nitrogen, or fluorine. These elements have strong electron-attracting power, and the hydrogen atom serves as a bridge between them. The hydrogen bond is much weaker than the ionic or covalent bonds. The friction of wet substrate on a surface is directly proportional to the extent of hydrogen bonds. Since materials composed of naturally-derived hydrophilic polymers have a large number of hydroxyl groups available for hydrogen bonding, it provides more grip or friction in comparison to the synthetic substrates, which do not have free hydroxyl groups for hydrogen bonding.

One skilled in the art will understand that materials, in particular nonwoven materials, composed of naturally derived hydrophilic fibers rather than synthetic fibers, have a greater total absorbency, greater liquid retention when subjected to pressure because the aqueous liquid is held more tightly within the fibers, as well as higher wet surface friction. These observations are also true for fibrous materials composed of a homogeneous blend of naturally hydrophilic and synthetic fibers when the level of naturally hydrophilic fibers is greater than the level of synthetic fibers.

One skilled in the art will also understand that fibers which are synthetic based and thus naturally hydrophobic such as polyester, polypropylene, polyethylene, and acrylic, can be treated with chemicals to make them behave in a more hydrophilic way. For example, surfactants can be applied on the outer surface of fibers after the fibers have been formed into a nonwoven or the surfactant can be added to the synthetic polymer during the extrusion process. While these steps can create a more hydrophilic composition by reducing the surface tension of the synthetic hydrophobic fiber, these fibers still lack the functional sorption sites that naturally hydrophilic fibers such as rayon, cotton, acetate and the like contain. So while these treated synthetic hydrophobic fibers have the ability to absorb greater amounts of liquid relative to the untreated synthetic hydrophobic fibers, they still lack the ability to tightly bind to water or create high wet surface friction through hydrogen bonds. Conversely, one skilled in the art will understand that fibers which are naturally hydrophilic can be treated to render the fibers hydrophobic. The outer surface of a nonwoven composed of rayon fibers can be coated with silicone. This treatment causes naturally hydrophilic fibers to have less affinity for water and less wet surface friction.

When natural-based hydrophilic fibers are included on the bottom layer of a cleaning pad, the wetting of the surface being cleaned is improved. Soil retention is also improved because of the presence of hydroxyl groups sorption sites. This results in the dirt being collected on the lower surface of the bottom layer rather than allowed to reach the absorbent core of the pad. However, it has been observed that the dirt trapped on the lower surface of the bottom layer can eventually get scraped off the pad resulting in soil re-deposition which leaves a film on the floor when the excess solution evaporates.

It is believed that a bottom layer comprising a specific high friction region with a specific transient region (preferably a low frinction region in order to maximize transient properties), which are both located within the "functional" surface of the bottom layer, improves the general cleaning efficacy of the cleaning pad, in particular the efficacy of a pad comprising a superabsorbent material. Because of the proximity between the high friction region and the low friction transient regions, it is also believed that in the event some of the dirt trapped on the high friction region is released, this dirt will be recaptured by the pad by "flowing" through the low friction transient region.

Figure 13:
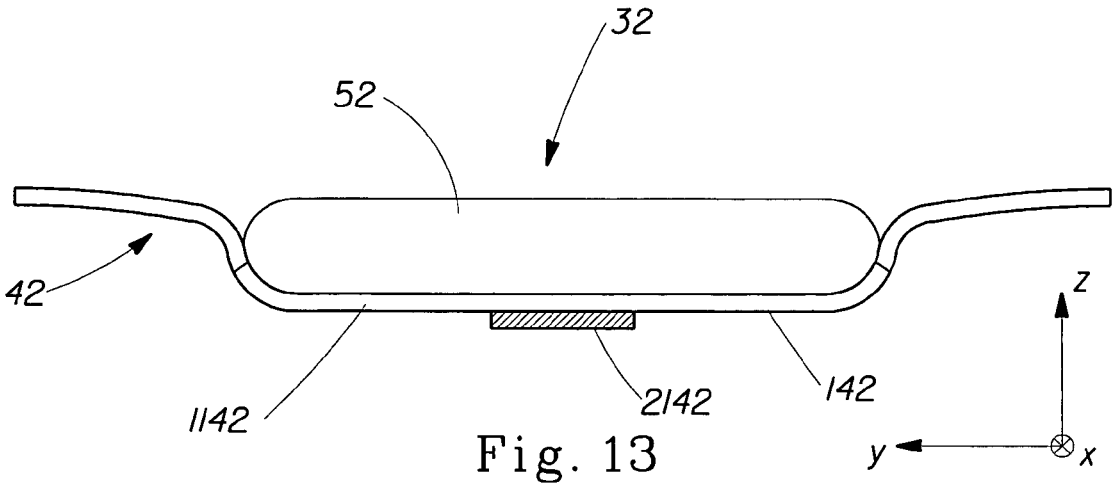
FIG. 13 is a cross-sectional view of another embodiment of a cleaning pad.
Figure 14:
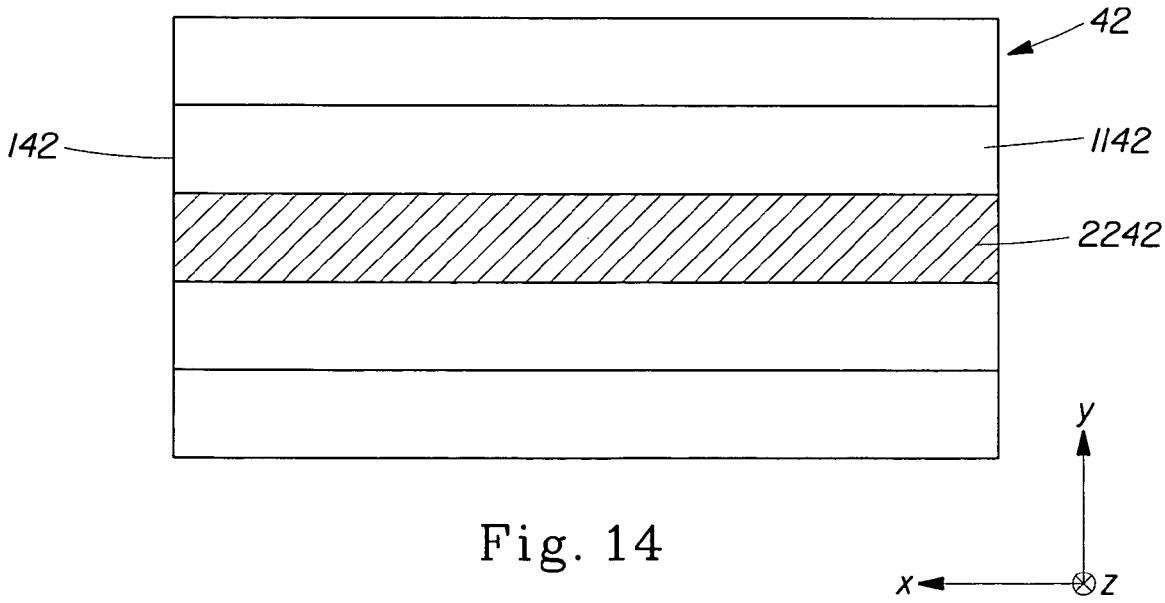
FIG. 14 is a bottom view of the cleaning pad of FIG. 13.

In one embodiment shown in FIGS. 13 and 14, a cleaning pad 32 comprises a bottom layer 42 having a "functional" surface 142, and which is in fluid communication with an absorbent core 52. The "functional" surface 142 has a first layer of hydrophobic material which forms a low friction zone 1142 and a second layer of hydrophilic material which forms a high friction zone 2142 in the form of a strip that is in direct fluid communication with the first layer 1142. During the cleaning operation, the high friction region(s) and the low friction region(s) located within the "functional" surface of the pad are both in contact with the floor surface.

It is found that having distinct high friction region(s), comprised of natural-based hydrophilic polymers, on the bottom layer of the pad also improves the ability of the pad to spread the cleaning solution over a greater surface during the cleaning operation while the transient region(s) facilitates flow of the soils and solution towards the absorbent core of the pad.

It has also been found that when the bottom layer of the pad include specific high friction region(s) in addition to specific low friction region(s), the overall friction between the pad and the floor (either wet or dry) is increased, but even more so when the floor surface starts to dry because the hydrogen bonds formed by the sorption sites become harder to "break".

As previously discussed, a user intuitively associates the friction between the pad and the floor with cleaning efficacy and well as the need to apply more cleaning solution. As a result, a user applies more cleaning solution, which provides better cleaning when the cleaning implement is used in combination with a highly absorbing pad.

In order to evaluate the impact of the hydrophilic fibers on friction in a wet environment, the following "Coefficient of Friction" test is conducted with different substrate materials.

"Coefficient of Friction" Test Method

The "Coefficient of Friction" test method uses a Friction/Peel Tester Model 225-1 (from Thwing-Albert Instrument Company, Philadelphia, Pa., USA 19154). This instrument can be used to measure both the static and kinetic coefficients of friction of a material. The coefficient of friction of a material can be viewed as the number U which is equal to the resistive force of friction Fr divided by the normal or perpendicular force pushing the objects together Fn.

One skilled in the art will understand that when an object (or solid), which is in contact with a substantially flat smooth surface, is subjected to a force, this solid remains immobile until the resistive force caused by the static friction is overcome. The kinetic friction (or drag force) is the force holding back regular motion once the static friction has been overcome.

Both the static friction, but more particularly, the kinetic friction have an impact on the ability of a pad to be wiped on a hard surface, in particular when the surface is wet.

Figure 15:
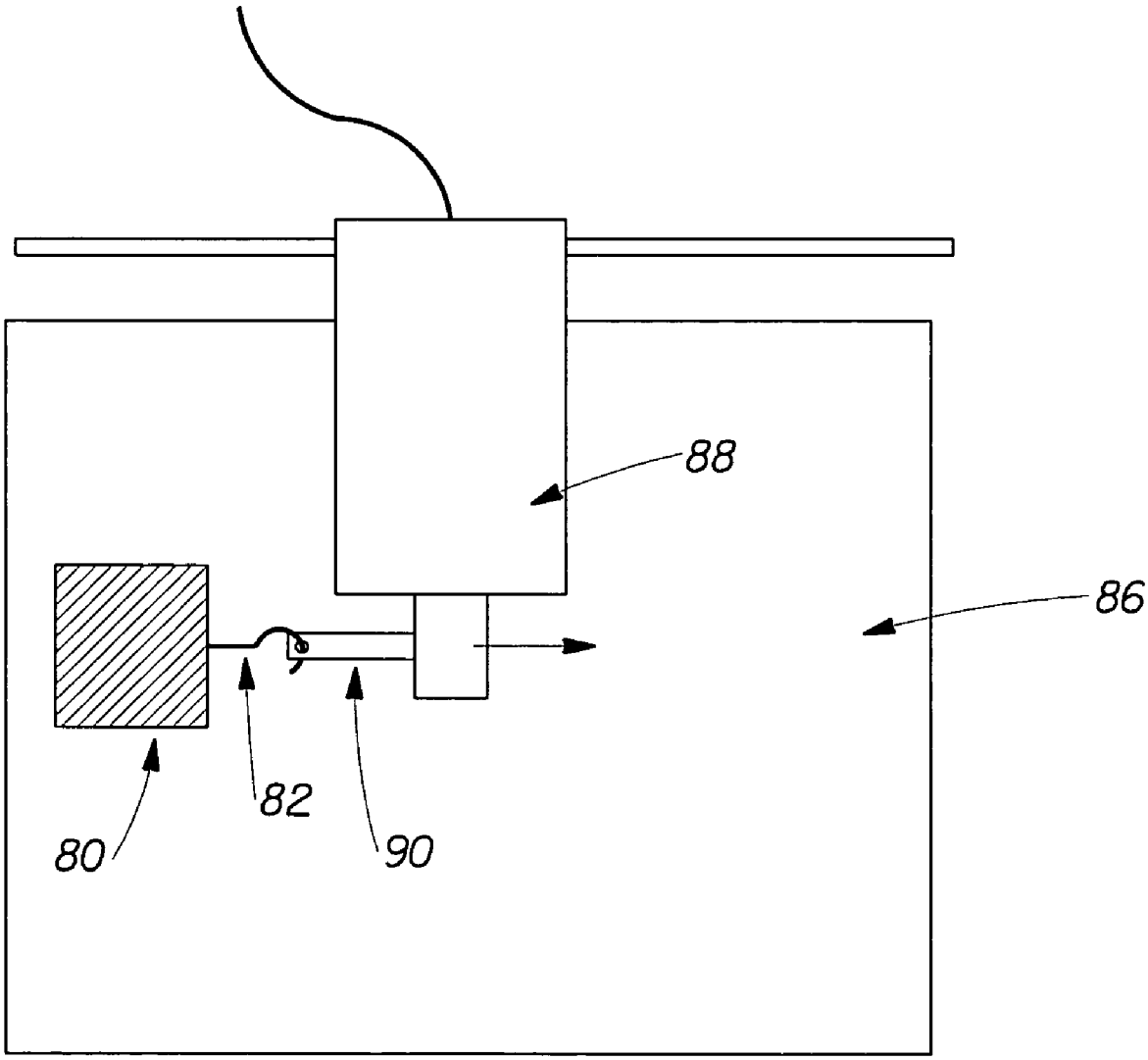
FIG. 15 is a schematic representation of the "Coefficient of Friction" Test.

The "Coefficient of Friction" test is schematically represented in FIG. 15. Preparation of the sample material to be tested Friction is measured using a 200 g sled. Three samples of the substrate material to be tested and measuring 10 cm by 10 cm are cut. A first sample 80 is wrapped around a 200 g sled which is used for testing (slits are cut at the leading edge of the substrate to allow clearance for the hook 82 attached to the sled which is attached to the test arm of the unit). The sled is composed of metal and is covered with 2 mm thick dense foam on its top and bottom surfaces and then further covered with a plastic laminate material for waterproofing. The sled dimensions are 6.5 cm×6.5 cm×1.5 cm. The test sample 80 is maintained in place with SCOTCH® adhesive tape. The pressure per unit area created by the sled is about 4.7 g/cm$^2$. This pressure simulates a typical amount of pressure applied on a pad by a lightweight mop while cleaning a floor (700 g mop+ bottle filled with cleaning solution and bottom surface of the mop head covering about about 300 cm$^2$).

Preparation of the Test Surface

The test surface 86 is a smooth, matte black ceramic tile (available from Interceramic under code 30301212, made in Chihuahua, Mexico) and is 30 cm wide by 30 cm long and 10 mm thick.

Test procedure:

1. Press the "Sled" button of the tester device repeatedly until the sled weight displayed is 200 g (corresponding to the weight of sled used in the test)
2. Press the "Test Time" button repeatedly until 20 seconds is displayed for time.
3. Set the speed of the sled by pressing the "Test Speed" button at 1 cm/sec (in order to check press speed, press test, press return)
4. Using the "Return" switch, position the load cell 88 to the starting point for test.
5. Place the first sample and sled on top of the ceramic tile at about 5 mm from back edge of the ceramic tile test surface 86 such that the sled is lined up at the center of the path where the hook 82 on the sled lines up with the eyelet 90 of the load cell 88 (the eyelet should be about 1 cm from the side edge of the tile which is parallel to the direction of the sled's forward motion, and 8.5 cm from the back edge of the tile which is perpendicular to the direction traveled by the sled). Then, press the "Zero" switch in order to zero the load cell.
6. Using the clamp attach the sled to the load cell.
7. Initiate test by depressing the "Test" switch. The load cell starts moving from the left to the right dragging the sled and the test sample. The distance traveled by sled as measured from the back edge of the sled in the starting position to front edge of the sled in the ending position is about 25 cm.
8. When the test is complete, the load cell stops and the device display the measure of the Static Coefficient of Friction (ST) as well as the Kinetic Coefficient of Friction (KI). Record the measure of the Kinetic Coefficient of Friction for the dry sample.
9. Hit the "Return" switch such that the sled with the sample return to the starting position. Carefully unhook the sled from the load cell. Using a pipette apply 1 ml of SWIFFER WETJET® ADVANCED CLEANER solution (available from the Procter & Gamble Company) directly on the ceramic tile. The cleaning solution should be applied at the center of the area of the tile where the sled with the sample substrate are located at the start of the experiment. The cleaning solution should be applied on an area of about 50 mm in width (the width being defined as the longitudinal dimension perpendicular to the direction of the sled) by 20 mm in length (the length being defined as the dimension parallel to the direction of the sled in motion). Position the sled with the test sample directly over the cleaning solution. Then press the "Test" switch in order to initiate the test.
10. Again when the test is completed, the load cell stops and the device display the measure of the Static friction and the Kinetic Coefficient of friction. Record the measure of the Kinetic Coefficient of Friction for a "wet" sample at 1 ml of solution.
11. Again hit the Return switch to send the sled back to the start position.
12. Remove the test sample from the tile surface, apply a second 1 ml of cleaning solution on the tile as previously discussed and again place the sled and the substrate sample on top of cleaning solution.
13. Initiate the test and record the measure of the "wet" Kinetic Coefficient of Friction at 2 ml of cleaning solution.
14. Repeat the procedure one last time with a 3rd 1 ml of cleaning solution and record the Kinetic Coefficient of friction at 3 ml of cleaning solution. Note that the time between the loadings of the 1 mil of solution and the test runs should not exceed 1 minute.
15. Remove the substrate from the sled and remove the ceramic test tile in order to clean the top surface of the tile. Using a solution comprising 20% of Isopropyl Alcohol (hereinafter IPA), thoroughly wipe off any excess of solution residue that may be left on the tile using paper towel. Repeat this procedure 3 times. Using de-ionized water do one final wipe of the top surface of the tile and buff this surface until it is dry.
16. Reposition the tile in the testing device. Take the sled and wipe it dry in order to remove any wetness from the previous test. Attach a second sample of substrate.
17. Repeat steps 4 through 16 and record the results as data for the second repetition for the sample 1 substrate.
18. Repeat steps 4 through 16 one more time and record the results as data for the third repetition for the sample substrate 1. Calculate and record the average of each results (i.e. "dry" sample, "wet" sample at 1 ml, "wet" sample at 2 mls and "wet" sample at 3 mls).
19. Clean the top surface of the tile and the sled using the procedure described in step 15 and 16 above.
20. Take 3 sample of another material and repeat the entire procedure for each type of material.

Various types of materials (including different nonwoven materials) are tested according to the previously discussed procedure. Since the degree of hydrophobicity or hydrophilicity of the different materials tested varies, it is possible to assess the impact or "behavior" of these materials on the ability of a cleaning pad to "glide" on a hard surface. The different samples tested also vary from a surface characteristic standpoint. Some of these materials have a very smooth outer surface while others are highly textured (due to the presence of "large" openings). It is believed that a substrate material having a smooth outer surface results in higher friction due to the greater surface of the material being in contact with the hard surface.

Table 1 provides a summary of the different Kinetic Coefficient of friction measured for different kind of substrates. Four Kinetic Coefficients of friction are reported as "Dry", "Low dose" (measured when 1 ml of cleaning solution was applied) and "High dose" (measured when 3 mls of cleaning solution was applied). One skilled in the art will understand that the "low dose" and "high dose" in the above experiment are equivalent to 0.025 mls and 0.075 mls of solution per square centimeter of substrate, respectively

TABLE 1

| Example | Supplier | Sample Characteristics Type of material Basis weight Texture Composition | Kinetic Coefficient of Friction Dry | Lo Dose | Hi Dose | % Change Compared to Dry Lo Dose | Hi Dose |
|---|---|---|---|---|---|---|---|
| 1 | Greenbay Nonwovens | Spun-lace nonwoven, 50 g/m$^2$, no texture, 100% Polyester | 0.33 | 0.39 | 0.35 | +19 | +7 |
| 2 | Greenbay Nonwovens | Spun-lace nonwoven, 50 g/m$^2$, with texture, 100% Polyester | 0.30 | 0.36 | 0.34 | +20 | +14 |
| 3 | Greenbay Nonwovens | Spun-lace nonwoven, 50 g/m$^2$, no texture, 35% Rayon, 65% Polyester | 0.32 | 0.55 | 0.38 | +75 | +22 |
| 4 | Greenbay Nonwovens | Spun-lace nonwoven, 50 g/m$^2$, no texture, 50% Rayon, 50% Polyester | 0.29 | 0.63 | 0.51 | +116 | +75 |
| 5 | Greenbay Nonwovens | Spun-lace nonwoven, 50 g/m$^2$, no texture, 65% Rayon, 35% Polyester | 0.30 | 0.60 | 0.59 | +102 | +98 |
| 6 | Greenbay Nonwovens | Spun-lace nonwoven, 50 g/m$^2$, with texture, 65% Rayon, 35% Polyester | 0.32 | 0.45 | 0.42 | +44 | +31 |
| 7 | Greenbay Nonwovens | Spun-lace nonwoven, 70 g/m$^2$, with texture and apertures, 70% Rayon, 30% Polyester | 0.31 | 0.53 | 0.48 | +71 | +55 |
| 8 | Buckeye Technologies Inc | Latex bonded Air-laid tissue, 50 g/m$^2$ No texture, Viocell 6205, >90% cellulose | 0.29 | 0.69 | 0.71 | +134 | +142 |
| 9 | Buckeye Technologies Inc | Latex bonded Air-laid tissue, 55 g/m$^2$ with texture, Viocell 6302, >90% cellulose | 0.33 | 0.64 | 0.68 | +93 | +106 |
| 10 | Tredegar Industries | Apertured formed film, 20 g/m$^2$, "funnel" shape openings extending towards the absorbent core 100% polyethylene | 0.79 | 0.25 | 0.24 | −68 | −70 |
| 11 | BBA Group | Thermal bond nonwoven, 20 g/m$^2$, no texture 100% polypropylene | 0.28 | 0.33 | 0.28 | +18 | 0 |
| 12 | Tenotex Nonwovens | Thermal bond nonwoven, 20 g/m$^2$, with texture 100% polypropylene | 0.24 | 0.3 | 0.24 | +25 | 0 |
| 13 | Tenotex Nonwovens | Thermal bond nonwoven, 20 g/m$^2$, with texture 30% Rayon 70% polypropylene | 0.32 | 0.39 | 0.30 | +22 | −6 |
| 14 | Tenotex Nonwovens | Thermal bond nonwoven, 20 g/m$^2$, with texture 50% Rayon 50% polypropylene | 0.27 | 0.56 | 0.36 | +107 | +33 |

The results reported in Table 1 show that to the exception of a substrate made of an apertured formed film (Example 10), the "low and high" Kinetic Coefficient of friction (herein after "KCF") of the substrate materials are greater than the "dry" KCF.

As previously discussed, apertured formed films made of a hydrophobic material and comprising "funnel" shape openings extending away from the hard surface, have a relatively high KCF against a dry surface but a relatively low KCF against a wet surface (as much as a 70% reduction of the KCF between "dry" and "wet"). This type of material can be advantageously used for the bottom layer of a cleaning pad for its highly "transient" characteristics previously defined as "the ability of soil and dirt and liquid to pass through a layer of a material without being substantially absorbed or hung-up on the material".

Fibrous materials, which have good "transient" characteristics, can also be advantageously used for the bottom layer of a cleaning pad. Suitable fibrous materials (either woven or nonwoven) can be made of 100% synthetic polymer (such as polyester, polypropylene, polyethylene and the like) or can be made of a blend of naturally hydrophilic and synthetic fibrous materials such that the level of hydrophilic fibrous material (e.g. cellulose, rayon, cotton and the like) is less than about 50%, preferably less than about 40%, more preferably less than about 35%. It has been also observed that the "transient" characteristic can be further increased when these materials have basis weights of less than about 60 g/m$^2$, preferably less than about 50 g/m$^2$, more preferably less than about 40 g/m$^2$ and even more preferably less than about 30 g/m$^2$. Nonwoven substrates having these characteristics are shown in examples 1-3 and 11-13. Without intending to be bound by any theory, it is believed that the lower the basis weight of the substrate material, the easier it is for a liquid to flow through a bottom layer made from this substrate in order to reach the absorbent core. As a result, the substrates of examples 11-13 provide excellent "transient" characteristics. However, when the basis weight of the substrate is less than 30 g/m$^2$ or when the level of hydrophilic fibers is less than 50%, it is observed that these materials have a relatively low KCF against a wet surface (less than about 40 against dry surfaces or at low dose of solution). It is further observed that the KCF of these materials decreases when a greater amount of cleaning solution is applied on the hard surface (KCF of less than about 30) and tends to return to the level of KCF against a dry surface.

It is also observed that fibrous materials comprising at least about 50% of hydrophilic material such as examples 4-9 and 14 while having a relatively low KCF against a dry surface (less than about 0.35), show an increase in KCF (greater than about 0.35) when wiped against a wet surface with a low level of solution. In addition, the KCF of these materials is maintained at a relatively high level when more cleaning solution is applied onto the hard surface, especially when the basis weight of these materials is more than about 20 g/m$^2$, preferably more than about 30 g/m$^2$, more preferably more than about 40 g/m$^2$ and even more preferably more than 50 g/m$^2$.

In one embodiment, the high friction region(s) 2242 comprises a material, preferably a nonwoven material, including at least about 50%, preferably at least about 55%, more preferably at least about 60%, even more preferably at least about 65% and most preferably at least about 70% of hydrophilic fibers. In one embodiment, the high friction region(s) 2242 comprises a material, preferably a nonwoven material, having a basis weight of at least about 20 g/m$^2$, preferably of at least about 30 g/m$^2$, more preferably of at least about 40 g/m$^2$, even more preferably of at least about 50 g/m$^2$ and most preferably of at least 60 g/m$^2$. The high friction region(s) 2242 comprises a material, preferably a nonwoven material, having a basis weight of less than about 250 g/m$^2$, preferably of less than about 200 g/m$^2$, more preferably of less than about 150 g/m$^2$, even more preferably of less than about 125 g/m$^2$.

In one embodiment, the high friction region(s) 2242 comprises a material, preferably a nonwoven material, having a "dry" KCF as measured by the "Coefficient of Friction" test, of less than about 0.5, preferably less than about 0.45, more preferably of less than about 0.4 and even more preferably of less than about 0.35.

In one embodiment, the "low dose" KCF as measured by the "Coefficient of Friction" test of the high friction region(s) 2242 is of at least about 0.35, preferably at least about 0.45, more preferably of at least about 0.55, even more preferably of at least about 0.6. The "High dose" KCF as measured by the "Coefficient of Friction" test of the high friction region(s) 2242 is of at least about 0.35, preferably at least about 0.45, more preferably of at least about 0.5, even more preferably of at least about 0.55.

One skilled in the art will understand that the size of the high friction region(s) can be adjusted in order to reduce or increase the amount of friction between the cleaning pad and the hard surface being cleaned. By way of example, a relatively small high friction region comprising a material having a high KCF can provide as much friction as a relatively large high friction region comprising a material having a low KCF.

One skilled in the art will understand that by reducing the total contact surface between a substrate and a hard surface it is also possible to reduce the overall friction between the substrate and the hard surface. Consequently, a possible solution to reduce the overall friction of a substrate having a relatively high KCF is to provide this substrate with a texture on at least its lower surface or openings made through the substrate.

In one embodiment, the low friction transient region(s) 1142 comprises a material, preferably a nonwoven material, including at least about 50%, preferably at least about 55%, more preferably at least about 60%, even more preferably at least about 65% and most preferably at least about 70% of hydrophobic fibers. In one embodiment, the low friction region(s) 1142 comprises a material, preferably a nonwoven material, having a basis weight of at least about 10 g/m$^2$, preferably of at least about 15 g/m$^2$, more preferably of at least about 20 g/m$^2$, The low friction region(s) 1142 comprises a material, preferably a nonwoven material, having a basis weight of less than about 100 g/m$^2$, preferably of less than about 80 g/m$^2$, more preferably of less than about 70 g/m$^2$, even more preferably of less than about 60 g/m$^2$ and a density of about 0.1 g/cm3, preferably less than about 0.09 g/cm3, more preferably less than about 0.08 g/cm3 and even more preferably less than about 0.07 g/cm3.

In one embodiment, the low friction region(s) 1142 comprises a material, preferably a nonwoven material, having a "dry" KCF as measured by the "Coefficient of Friction" test, of at least about 0.2, preferably at least about 0.25, more preferably of at least about 0.3 and even more preferably of at least about 0.5.

In one embodiment, the "low dose" KCF as measured by the "Coefficient of Friction" test of the low friction region(s) 1142 is less than about 0.5, preferably less than about 0.4, more preferably of less than about 0.35, even more preferably less than about 0.3. The "High dose" KCF as measured by the "Coefficient of Friction" test of the low friction region(s) 1142 is less than about 0.45, preferably less than about 0.4, more preferably of less than about 0.35, even more preferably less than about 0.3.

In a preferred embodiment, the low friction region(s) 1142 comprises an apertured formed film made of a polyolefin, preferably a polyethylene. While creating apertures during the forming of the film is preferred, it is understood that similar characteristics could be achieved by aperturing after the forming of the film. In other words, the apertures are made by taking an already formed film and creating apertures using cutting dyes, needles and similar aperting processes.

When a nonwoven material is present in either the high friction hydrophilic or low friction transient regions, the nonwoven(s) can be made via any process known in the art. Non-limiting examples of suitable processes include spun-lacing, spun-bonding, melt-blowing, air-laying, thermal bonding and any combinations thereof.

Non-limiting examples of hydrophilic fibrous material that also result in high friction include rayon, cellulose pulp, cotton, and the like, and any combinations thereof.

It has been observed that when the entire bottom layer of a cleaning pad is "highly" textured and/or has relatively large openings (i.e. each opening having a projected surface in the X-Y dimension of more than about 0.5 mm$^2$), the bottom layer "paints" lines on the wet floor surface which result in unwanted filming and streaking when the excess solution evaporates from the floor surface.

Figure 16:
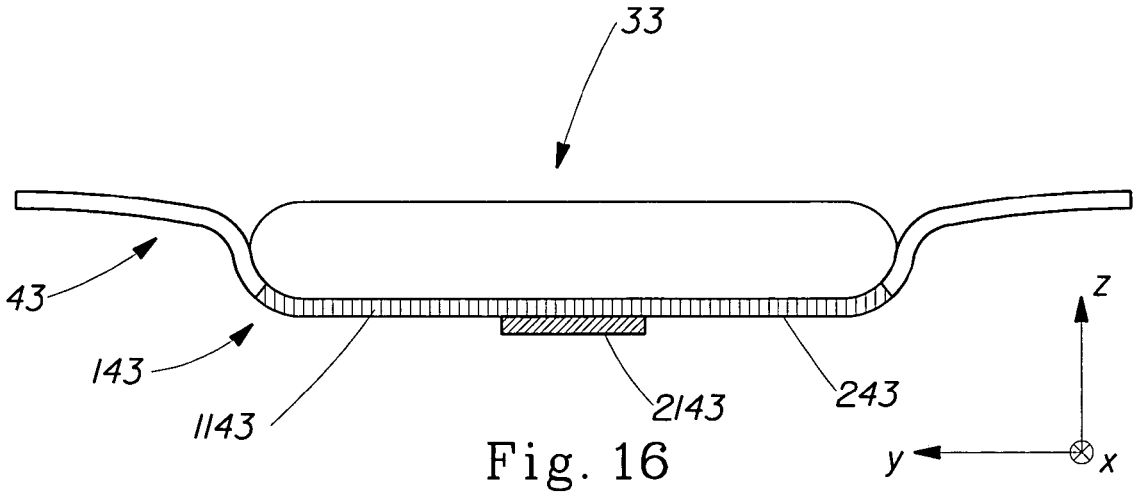
FIG. 16 is a cross-sectional view of another embodiment of a cleaning pad.
Figure 17:
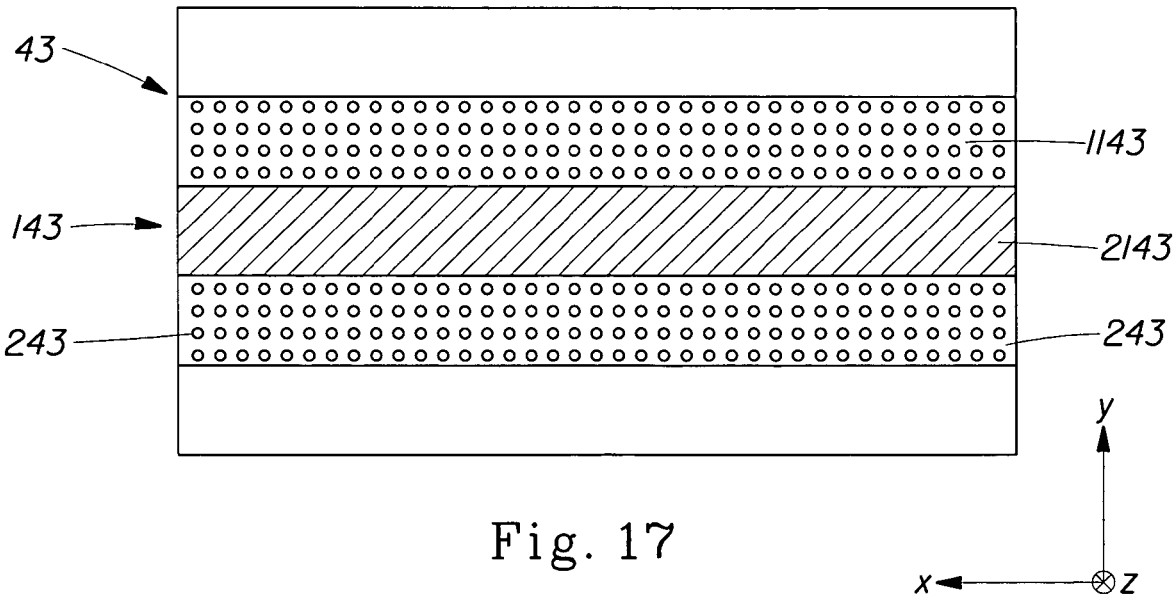
FIG. 17 is a bottom view of the cleaning pad of FIG. 16.

In one embodiment shown in FIGS. 16 and 17, a cleaning pad 33 comprises a bottom layer 43 with a "functional" surface 143 comprising a first portion 1143 which is "highly" textured and/or comprises "large" openings 243 and a second portion 2143 which is relatively smooth. In a preferred embodiment, the bottom layer of the pad comprises a high friction region(s) and a low friction region(s) such that one of the hydrophobic or high friction region(s) is "highly" textured and/or comprises "large" openings, while the other hydrophilic or hydrophopic region(s) is substantially smooth and/or substantially pliable.

By "highly textured", it is meant that the substrate has peaks and valleys on its outer surface such that the distance between two consecutive peaks is greater than about 1 mm$^2$ the area defined by the peak is less than about 300 mm$^2$ and a z dimensional height from the bottom of the valley to the top of the peak is greater than about 0.3 mm. One skilled in the art will realize that in embodiments where there is a peak on top of a peak, that the z dimensional height is measured from the lower most valley to the upper most peak.

By "large openings", it is meant that the projected surface of each of the openings in the X-Y dimension is at least about 0.5 $mm^2$, preferably at least about 1 $mm^2$, more preferably at least about 2 $mm^2$.

By "substantially smooth", it is meant that texturing is slight and/or openings are small (less than about 0.5 $mm^2$).

By "substantially pliable" it is meant that the structure is deformable under pressure. In other words if a textured substrate is pliable the textures can minimized or eliminated when pressure is applied to the substrate during a normal mopping process (about 4.7 $g/cm^2$).

Among other benefits, the portions or regions which are highly textured and/or have large openings increase the cleaning efficacy of the bottom layer while the smooth portions or regions prevent the formation of lines on the hard surface by acting like a squeegee which smoothes out the lines painted by the textured material.

As previously discussed, the high friction region(s) tends to get more readily saturated with soil in comparison to the low friction region(s). As a result, when a user looks at the bottom surface of the pad after mopping a floor surface, he or she may have the impression that the pad is cleaning unevenly.

Figure 18:
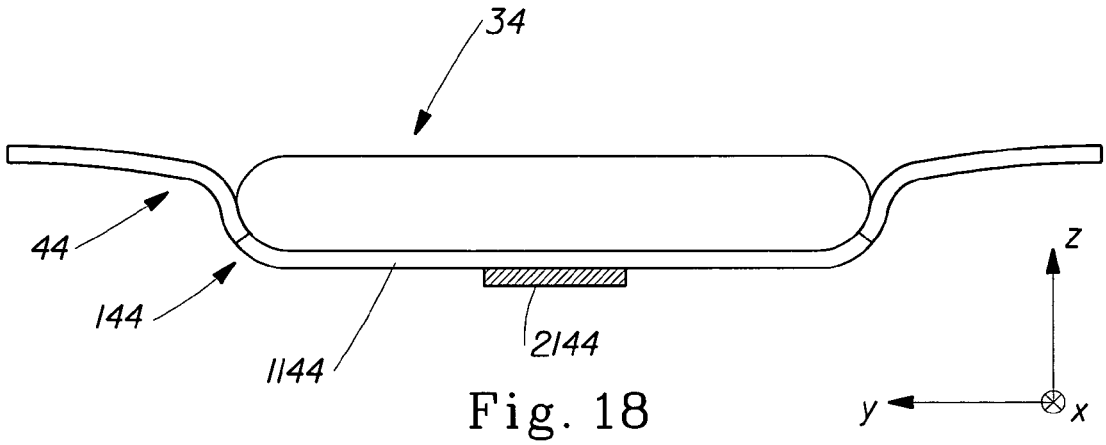
FIG. 18 is a cross-sectional view of another embodiment of a cleaning pad.
Figure 19:
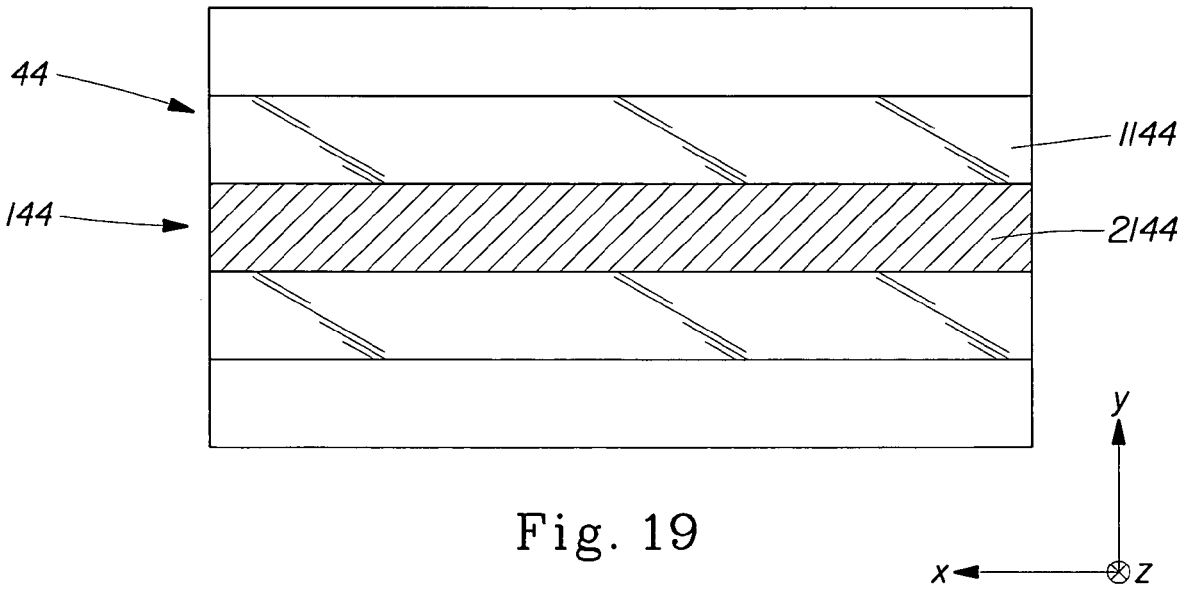
FIG. 19 is a bottom view of the cleaning pad of FIG. 18.

In one embodiment represented in FIGS. 18 and 19, the "functional" surface 144 of a pad 34 comprises at least one region 1144 which is at least translucent and preferably transparent. By "translucent", it is meant that this region is semi-transparent such that a contrasting surface behind the translucent material can be visual seen by the naked eye. In a preferred embodiment, the translucent region has a light transmission is greater than about 70%, preferably greater than about 80% and more preferably greater than about 90% as measured using the standard ASTM D2457 test method with measurements taken at 60 degree angle setting. In one embodiment, the translucent region has a haze of less than about 80%, preferably less than about 60% and more preferably less than about 40% as measured by standard ASTM method ASTM D1003. In a preferred embodiment, the "functional" surface 144 comprises at least one low friction region 1144 which is at least translucent but preferably transparent and at least one high friction region 2144 which is substantially opaque. A translucent or transparent region, allows the user to inspect visually the bottom surface of the cleaning pad and evaluate the amount of dirt being trapped in the absorbent core. One skilled in the art will understand that the greater the amount of dirt trapped in the absorbent core, the darker the translucent or transparent region will appear. Consequently, a user can better evaluate the need to replace and dispose the pad being used.

A translucent region is obtained by adding a low level of coloring agents (for example a whitening agent such as titanium dioxide) to the polymer during the manufacturing process of the apertured formed film or nonwoven substrate. A transparent region is obtained when no coloring agent is added to the polymer used to create the apertured formed film or nonwoven substrate in the manufacturing process.

One skilled in the art will understand that any of the previously discussed cleaning pads can be pre-impregnated with a cleaning solution such that this pad can be used with so called "dry" cleaning implement which does not carry their own source of cleaning solution. The cleaning solution can be any detersive solution known in the art. A non-limiting example of a suitable cleaning solution includes water, one or more surfactant(s), optionally a solvent, optionally a sud-suppressor, optionally one or more anti-bacterial agent(s), optionally one or more polymers, and any combinations thereof.

In addition to the previously disclosed cleaning pads, it is found that the cleaning efficacy of any cleaning pad can be improved without having to modify the cleaning pad.

Typically, the user of a cleaning implement that delivers the cleaning solution over a small area (i.e. 3 mls over less than 0.1 $m^2$) with a liquid delivery mechanism actuated for one second) is instructed to actuate the mechanism and dispense the solution on the hard surface while the implement is in a stationary position and the pad is in contact with the floor. Once a few milliliters of solutions are applied, the user is then instructed to wipe up and down over a given area (typically an area of about 0.5 m wide by 1 m long). After wiping this first area the user typically positions the mop head of the implement adjacent a dry area of the floor, he or she dispenses again some cleaning solution and repeats this process until the entire surface is cleaned.

It is believed that cleaning efficacy of wet cleaning implements is increased when the user is instructed to actuate the liquid delivery mechanism while holding the cleaning implement such that the mop head is not in contact with the floor surface. The user can be instructed to maintain the liquid delivery mechanism actuated and to apply the cleaning solution over an area of the floor surface of at least about 0.5 $m^2$, preferably at least about 1 $m^2$, even more preferably at least about 1.5 $m^2$. When a relatively large surface has been "wetted" (preferably at least about 5 $mls/m^2$, more preferably at least about 10 $mls/m^2$ and even more preferably at least 15 $mls/m^2$), the user is instructed to wipe the "wet" surface with the cleaning pad.

In another embodiment, the user can also be instructed to actuate the liquid delivery mechanism when the cleaning pad is in contact with the floor surface and to maintain the liquid delivery mechanism actuated while wiping the floor surface in a back and forth motion. Both these methods of cleaning a surface provide a better and more even wetting of the floor surface which is particularly beneficial when the cleaning implement is used with a highly absorptive pad as previously discussed.

The methods previously discussed improve the cleaning efficacy of any type of cleaning implement but in particular the efficacy of cleaning implements that deliver the cleaning solution over a relatively small area. The cleaning efficacy of the later is even greater if these implements are used with a cleaning pad comprising a superabsorbent material.

In one embodiment, at least one cleaning pad having a superabsorbent core and which is placed in a package can be sold to consumers as a cleaning kit. The package can include instructions in the form of words, drawings or pictures instructing the user to follow the steps of one of methods of cleaning a surface previously discussed. It will be understood that the instructions can also be printed directly onto the cleaning pad, the reservoir or conveyed to the consumer via audiovisual recordings. In one embodiment, the cleaning kit further comprises a reservoir filled with a cleaning solution and means for dispensing the solution on a hard surface. Non-limiting examples of suitable dispensing means include a hand sprayer or a squirt bottle.

The previously discussed cleaning kits can be particularly advantageous to generate trials of the cleaning pads in particular with consumers who already own a "dry" cleaning implement (such as the SWIFFER® cleaning implement or the PLEDGE GRAB-IT® cleaning implement) but are reluctant to purchase an additional tool such as the wet cleaning implements previously discussed. The cleaning kits can also generate trials of the cleaning pads with superabsorbent materials among consumers who already own a cleaning implement capable of delivering the cleaning solution within a relatively small area. As these cleaning kits are directed towards consumers who already own either a "dry" cleaning implement or a "wet" cleaning implement, these consumers can be identified via phone surveys, coupons sent via mail or email or downloaded directly by the consumer from a website over the Internet. It has been shown that when consumers are given an opportunity to try such a cleaning pad, their perception of the product utility is improved.

While particular embodiments of the subject invention have been described, it will be apparent to those skilled in the art that various changes and modifications of the subject invention can be made without departing from the spirit and scope of the invention. In addition, while the present invention has been described in connection with certain specific embodiments thereof, it is to be understood that this is by way of limitation and the scope of the invention is defined by the appended claims which should be construed as broadly as the prior art will permit.

What is claimed is:

1. A disposable cleaning substrate comprising:

a bottom layer for contacting a surface to be cleaned and having a lower surface; and an absorbent layer in direct fluid communication with said bottom layer, wherein said bottom layer is transparent and comprises a first layer made of a hydrophilic material connected to a second layer made of a hydrophobic material.

2. The disposable cleaning substrate of claim 1 wherein said first layer is made of a nonwoven material.

3. The disposable cleaning substrate of claim 2 wherein said nonwoven material has a basis weight between about 30 $g/m^2$ and about 100 $g/m^2$.

4. The disposable cleaning substrate of claim 1 wherein said first layer has a "low dose Kinetic Coefficient of Friction" of at least about 0.35.

5. The disposable cleaning substrate of claim 4 wherein said first layer has a "low dose Kinetic Coefficient of Friction" of at least about 0.45.

6. The disposable cleaning substrate of claim 1 wherein said first layer has a "high dose Kinetic Coefficient of Friction" of at least about 0.35.

7. The disposable cleaning substrate of claim 6 wherein said first layer has a "high dose Kinetic Coefficient of Friction" of at least about 0.45.

8. The disposable cleaning substrate of claim 1 wherein said second layer has a "low dose Kinetic Coefficient of Friction" of less than about 0.5.

9. The disposable cleaning substrate of claim 8 wherein said second layer has a "low dose Kinetic Coefficient of Friction" of less than about 0.4.

10. The disposable cleaning substrate of claim 1 wherein said second layer has a "high dose Kinetic Coefficient of Friction" of less than about 0.45.

11. The disposable cleaning substrate of claim 10 wherein said second layer has a "high dose Kinetic Coefficient of Friction" of less than about 0.4.

* * * * *

UNITED STATES PATENT AND TRADEMARK OFFICE

CERTIFICATE OF CORRECTION

PATENT NO. : 7,480,956 B2
APPLICATION NO. : 10/866350
DATED : January 27, 2009
INVENTOR(S) : Nicola John Policicchio et al.

It is certified that error appears in the above-identified patent and that said Letters Patent is hereby corrected as shown below:

Title Page

(56) References Cited

Foreign Patent Documents

| | | | | |
|---|---|---|---|---|
| Insert -- | EP | 0 222 955 A | 05-27-1987 | Spontex SA |
| | EP | 0 703 308 A | 03-27-1996 | Unitec Corp. |
| | EP | 1 212 972 A | 06-12-2002 | KAO Corp. |
| | JP | 10 155713 abstract | 06-16-1998 | Uni Charm |
| | WO | 00/027271 A | 05-18-2000 | Jackson et al. --. |

Column 4

Line 5, delete "Angle." and insert -- Angle, --.

Column 7

Line 22, delete "3040%" and insert -- 30-40% --.

Column 8

Line 2, delete "WETS" and insert -- WET® --.

Column 18

Line 32, delete "aperting" and insert -- aperturing --.

Line 63, delete "$mm^2$" and insert -- mm --.

Signed and Sealed this

Tenth Day of November, 2009

David J. Kappos

David J. Kappos
*Director of the United States Patent and Trademark Office*